United States Patent [19]

Wheaton

[11] Patent Number: 4,680,095

[45] Date of Patent: Jul. 14, 1987

[54] CONTINUOUS PREPARATION OF DIALKANESULFONYL PEROXIDE

[75] Inventor: Gregory A. Wheaton, Gloucester, N.J.

[73] Assignee: Pennwalt Corporation, Philadelphia, Pa.

[21] Appl. No.: 926,286

[22] Filed: Nov. 3, 1986

[51] Int. Cl.[4] ..... C25B 3/02

[52] U.S. Cl. ..... 204/79; 204/78; 568/28

[58] Field of Search ..... 204/78, 79, 59 R; 568/28

[56] References Cited

U.S. PATENT DOCUMENTS 2,619,507 11/1952 Jones et al. ..... 204/79

OTHER PUBLICATIONS

Heszeldine et al., J. Chem. Soc. (A), (1964) pp. 4901–4907.

Myall et al., J. Chem. Soc. (Penkins), (1975) pp. 953–955.

*Primary Examiner*—Arthur P. Demers

[57] ABSTRACT

Dialkanesulfonyl peroxide ($RSO_2—O—O—O_2SR$) is prepared in a continuous process by electrolyzing the corresponding alkanesulfonic acid at an elevated temperature (to keep the peroxide product in solution) in a continuous-flow electrolysis cell, removing the solution from the electrolytic cell, cooling the solution to precipitate the peroxide product, and recycling the supernatant alkanesulfonic acid back to the cell.

10 Claims, No Drawings

CONTINUOUS PREPARATION OF DIALKANESULFONYL PEROXIDE

BACKGROUND OF THE INVENTION

The present invention relates to an improved process for preparing dialkanesulfonyl peroxide ($RSO_2$—O—O—$O_2SR$) continuously by electrolysis of the corresponding alkanesulfonic acid at an elevated temperature.

Dimethanesulfonyl peroxide ("DMSP") was first produced by Jones and Friedrich [U.S. Pat. No. 2,619,507] by the batchwise electolysis of a 10.2N solution of methanesulfonic acid in water using shiny platinum plate electrodes at a current density of 0.2 amp/cm$^2$. This approach resulted in deposition of the DMSP on the anode and a poor current yield (less than 20%). Deposition of the peroxide on the electrodes also resulted in explosive decomposition in subsequent preparations of DMSP [R. N. Haszeldine, R. B. Heslop, and J. W. Lethbridge, J. Chem. Soc., Part A, 4901–7 (1964)]. Myall and Pletcher [C. J. Myall and D. Pletcher, J. Chem. Soc., Perkin Trans, 1 (10), 953–5 (1975)] produced DMSP by batchwise constant current electrolysis of a solution of sodium methanesulfonate in anhydrous methanesulfonic acid in a divided electrolysis cell. This method resulted in improved (63%) current yields, but it requires preparation of sodium methanesulfonate and recovery of the product peroxide requires extensive (5:1) dilution of the aqueous methanesulfonic acid using water. In addition, divided electrolysis cells are significantly more costly than undivided cells.

STATEMENT OF THE INVENTION

This invention is an improved process for producing dialkanesulfonyl peroxide by continuously electrolyzing a solution of an alkanesulfonic acid of 1–4 carbons at a sufficient current density to produce dialkanesulfonyl peroxide of the structure $RSO_2$—O—O—$O_2SR$ where R is alkyl of 1–4 carbons, wherein the concentration of the alkanesulfonic acid is between 50% and 100% by weight, in an undivided continuous flow electrolysis cell at an elevated temperature at which a substantial portion of the product dialkanesulfonyl peroxide is in solution, continuously removing the alkanesulfonic acid/dialkanesulfonyl peroxide product mixture from the cell to a cooling zone where the product mixture is cooled below the temperature in the cell to precipitate the dialkanesulfonyl peroxide product, continuously recovering the precipitated insoluble solid dialkanesulfonyl peroxide product from the alkanesulfonic acid solution, and recycling the alkanesulfonic acid directly to the electrolysis cell. Use of this method prevents deposition of the product peroxide on the anode.

DETAILED DESCRIPTION OF THE INVENTION

The process of the present invention employs an aqueous solution of an alkanesulfonic acid having carbon chain lengths of 1 to 4. Such sulfonic acids include, for example, methanesulfonic acid, ethanesulfonic acid, propanesulfonic acid, isopropanesulfonic acid, butanesulfonic acid, and isobutanesulfonic acid. The preferred sulfonic acid is methanesulfonic acid (MSA) because of its availability, low molecular weight, high innate solubility in water and high water solubility of its metal salts.

In the present invention, the concentration of the alkanesulfonic acid which can be used as feed to the electrolysis cell can vary between about 50% and about 100% by-weight. If the concentration of the alkanesulfonic acid used is greater than about 90% by-weight, the resistance to the passage of current requires that a high potential be applied. Also, if the concentration of the alkanesulfonic acid used is greater than about 90% by-weight, recovery of the product is difficult due to significantly increased solubility of the product in the more concentrated alkanesulfonic acid solution. Therefore, the preferred concentration of the alkanesulfonic acid which is used in the process of this invention is between about 50% and about 75% by-weight.

In the process of this invention, alkanesulfonic acid is consumed which decreases the concentration of alkanesulfonic acid in the aqueous supernatant solution containing the alkanesulfonic acid which is recycled to the electrolysis cell. In this process the reaction may be carried out until the concentration of alkanesulfonic acid in the supernatant solution decreases to the lowest useful concentration of about 50% by-weight; alternatively, the alkanesulfonic acid may be added to the alkanesulfonic acid depleted supernatant solution in order to maintain the concentration of alkanesulfonic acid in the recycled aqueous alkanesulfonic acid solution between about 50% by-weight and about 75% by-weight.

The electrodes employed in the process of this invention can be constructed of any suitable electrode material which is compatible with solutions of the alkanesulfonic acids. Platinum is the preferred electrode material and may be coated or deposited on a suitable substrate material which is compatible with solutions of the alkanesulfonic acid, such as graphite or stainless steel.

In the process of this invention, the temperature of the alkanesulfonic acid/dialkanesulfonyl peroxide mixture in the electrolysis cell can be from about 30° C. to about 70° C. and is preferably between about 45° C. and about 55° C. The alkanesulfonic acid/dialkanesulfonyl peroxide product mixture removed from the electrolysis cell can be cooled to between about 0° C. and about 25° C., preferably to between about 0° C. and about 10° C., in order to precipitate the dialkanesulfonyl peroxide product from the alkanesulfonic acid solution.

The current density employed in the process of this invention can be from about 0.10 to 2.00 amp/cm$^2$, and is preferably between about 0.10 to about 1.00 amp/cm$^2$.

The voltage used in the process of this invention can be whatever voltage is necessary to provide the desired current density and is dependant upon the temperature of the alkanesulfonic acid/dialkanesulfonyl peroxide mixture in the electrolysis cell, the electrode gap, the concentration of alkanesulfonic acid, and the electrode materials; the voltage is generally between about 1.0 and about 20.0 volts and is preferably between about 3.0 and 5.0 volts.

The following examples serve to further illustrate the process of this invention.

EXAMPLE 1

The continuous-flow electrolysis cell was constructed from 30 mm i.d. glass tubing with a glass inlet-tube located on one side about 1 cm up from the bottom of the cell and a liquid take-off tube (equipped with a siphon-break and a shut-off valve) located on the opposite side of the cell about 5 cm up from the bottom of the cell. A 14/20 ground-glass side-neck was located on the inlet-side about 8 cm up from the bottom of the cell and a threaded thermometer adapter was attached to the front of the cell about 7 cm up from the bottom of the cell. The cell was joined to a 29/42 outer joint at the top into which fits a Teflon® stopper. The stopper was equipped with two small holes (less than 1 mm in diameter) centered about 1 cm apart through which the wire electrode shafts were passed. The anode was a circular platinum plate (13 mm in diameter and 1 mm thick; 2.65 $cm^2$ area) attached to a 1 cm long perpendicular bend at the end of a 10 cm length of 1 mm diameter platinum wire. The platinum cathode was constructed in the same manner as the anode. The wire shaft of each electrode was insulated by encasing it in a 7 cm length of small-bore heat-shrinkable Teflon® tubing. The cathode plate was positioned directly over the anode plate, and the gap between the electrodes as well as the vertical position of the electrodes within the cell were adjusted by sliding the wire electrode shafts up or down through the Teflon® stopper. The electrode shafts were connected to a variable voltage dc power source. The cell was equipped with a Teflon®-coated magnetic stirring bar, a thermometer, and a reflux condenser. The inlet of the cell was connected to the discharge side of a peristaltic pump using Viton® tubing. The suction side of the peristaltic pump was connected to a sintered-glass gas dispersion tube by Viton® tubing, and the gas dispersion tube was placed in a 50 ml Erlenmeyer flask which served as the receiver for the liquid effluent from the liquid take-off tube of the electrolysis cell.

An aqueous solution of methanesulfonic acid (70% by weight methanesulfonic acid; 25 ml) was placed in the electrolysis cell and 15 ml of the same aqueous methanesulfonic acid solution was placed in the 50 ml Erlenmeyer receiver flask. The aqueous methanesulfonic acid solution was circulated by the pump through the system with stirring at a rate of about 8 ml/min. until all of the air had been dispelled from the tubing, then power was applied to the cell. The current and voltage to the cell were adjusted to 0.4 amp and 5.0 volts, respectively. The temperature of the liquid in the cell quickly increased to about 45°-50° C. and stabilized at that level.

The aqueous methanesulfonic acid/dimethanesulfonyl peroxide product mixture was continuously removed from the cell through the liquid take-off tube under gravity flow and was collected in the 50 ml Erlenmeyer receiver flask which was cooled to about 10° C. by immersion in an ice water bath. the contents of the Erlenmeyer receiver flask were filtered through the sintered-glass portion of the gas dispersion tube and recycled continuously to the electrolysis cell by the pump. This was continued for a total time of two hours during which time both the current and the voltage remained essentially constant. The solid product DMSP which had precipitated in the Erlenmeyer receiver flask was collected by filtration to yield 0.67 gm of DMSP.

The aqueous methanesulfonic acid/DMSP product mixture after filtration was analyzed by iodimetry and was found to contain an additional 0.68 gm of DMSP in solution. A total current yield of 47.1% of theoretical was obtained.

The solid product which was recovered melted at 80°-82° C. The equivalent weight as determined by iodimetry was 89.2 gm/equivalent (95.1 gm/equivalent calculated for DMSP). Raman spectrum showed a strong absorption at 815 $cm^{-1}$ assigned to the S—O—O—S linkage of DMSP. The $^1H$ NMR spectrum in deuterochloroform was a singlet at 3.30 ppm from TMS which is consistent with the spectrum previously reported [C. J. Myall and D. Pletcher, J. Chem, Soc., Perkin Trans., 1 (10), 953-5 (1975)].

EXAMPLE 2

Anhydrous methanesulfonic acid (about 99.6% by-weight) was passed through the continuous flow electrolysis cell used in Example 1 at a flow-rate of 2.17 ml/min and was electrolyzed using 0.5 amp and 20.0 volts. The methanesulfonic acid solution removed from the cell contained dimethanesulfonyl peroxide at a concentration of 6.0 gm/liter. No DMSP precipitated when the product mixture was cooled to about 5° C. in an ice water bath. A 10 gm portion of the product mixture was added to 10 gm of ice, the resulting solution was cooled to 5° C., and a flocculent white solid was recovered which was identical to that obtained in Example 1.

What is claimed:

1. A process for the continuous preparation of dialkanesulfonyl peroxide by continuously electrolyzing a solution of an alkanesulfonic acid having 1-4 carbons at a sufficient current density to produce dialkanesulfonyl peroxide of the structure $RSO_2$—O—O—$O_2SR$ where R is alkyl of 1-4 carbons, wherein the concentration of the alkanesulfonic acid is between 50% and 100% by-weight, in an undivided continuous flow electrolysis cell at an elevated temperature at which a substantial portion of the product dialkanesulfonyl peroxide is in solution, continuously removing the alkanesulfonic acid/dialkanesulfonyl peroxide product mixture from the electrolysis cell to a cooling zone where the product mixture is cooled below the temperature in the electrolysis cell to precipitate the dialkanesulfonyl peroxide product, continuously recovering the insoluble solid dialkanesulfonyl peroxide product from the alkanesulfonic acid, and continuously recycling the alkanesulfonic acid solution back to the electrolysis cell.

2. The process of claim 1 wherein the alkanesulfonic acid is methanesulfonic acid.

3. The process of claim 1 wherein the concentration of alkanesulfonic acid recycled to the electrolysis cell is maintained between 50% and 75% by-weight.

4. The process of claim 3 wherein anhydrous alkanesulfonic acid is added to the recycled aqueous alkanesulfonic acid solution in order to make the concentration of alkanesulfonic acid between 50% and 75% by-weight.

5. The process of claim 1 wherein the temperature of the alkanesulfonic acid solution in the electrolysis cell is between 30° C. and 70° C.

6. The process of claim 5 wherein the temperature of the alkanesulfonic acid solution in the electrolysis cell is between 45° C. and 55° C.

7. The process of claim 1 wherein the alkanesulfonic acid/dialkanesulfonyl peroxide product mixture removed from the electrolysis cell is cooled to a temperature between 0° C. and 25° C.

8. The process of claim 7 wherein the alkanesulfonic acid/dialkanesulfonyl peroxide product mixture is cooled to a temperature of 0° C. and 10° C.

9. The process of claim 1 wherein the current density employed is between 0.10 amp/$cm^2$ and 2.00 amp/$cm^2$.

10. The process of claim 9 wherein the current density employed is between 0.10 amp/$cm^2$ and 1.00 amp/$cm^2$.

* * * * *